US010285893B1

(12) United States Patent
Sands

(10) Patent No.: US 10,285,893 B1
(45) Date of Patent: May 14, 2019

(54) WALKER WITH DEPLOYABLE UMBRELLA

(71) Applicant: Roy A. Sands, Hollywood, FL (US)

(72) Inventor: Roy A. Sands, Hollywood, FL (US)

( * ) Notice: Subject to any disclaimer, the term of this patent is extended or adjusted under 35 U.S.C. 154(b) by 260 days.

(21) Appl. No.: 15/496,799

(22) Filed: Apr. 25, 2017

Related U.S. Application Data

(60) Provisional application No. 62/326,943, filed on Apr. 25, 2016.

(51) Int. Cl.

| | |
|---|---|
| ***A61H 3/04*** | (2006.01) |
| ***A45B 11/00*** | (2006.01) |
| ***A45B 17/00*** | (2006.01) |
| ***A45B 19/04*** | (2006.01) |
| *A61H 3/00* | (2006.01) |

(52) U.S. Cl.
CPC ..... *A61H 3/04* (2013.01); *A45B 11/00* (2013.01); *A45B 17/00* (2013.01); *A45B 19/04* (2013.01); *A45B 2200/1009* (2013.01); *A61H 2003/003* (2013.01)

(58) Field of Classification Search
CPC ..... A61H 2003/003; A45B 2200/1009; A45B 11/00; A45B 17/00; A45B 23/00; A45B 2025/003
See application file for complete search history.

(56) References Cited

U.S. PATENT DOCUMENTS

| | | | | |
|---|---|---|---|---|
| 2,822,143 | A * | 2/1958 | Johansen | A45B 11/00 135/16 |
| 4,570,894 | A * | 2/1986 | Miele | A45B 11/00 224/274 |
| D330,630 | S | 11/1992 | Loden | |
| 5,396,915 | A | 3/1995 | Bomar | |
| 5,551,745 | A * | 9/1996 | Huang | B60J 7/1282 135/133 |
| 5,836,327 | A * | 11/1998 | Davis | A45B 11/00 135/16 |
| 6,378,539 | B1 | 4/2002 | Allee | |
| 9,326,573 | B1 * | 5/2016 | Harris | A45B 11/00 |
| 9,476,541 | B1 * | 10/2016 | Kastner | F16M 13/02 |
| 2006/0207640 | A1 | 9/2006 | Connelly | |
| 2011/0297198 | A1 * | 12/2011 | Sibley | A61G 15/10 135/88.01 |

(Continued)

FOREIGN PATENT DOCUMENTS

| | | | |
|---|---|---|---|
| DE | 202011107303 U1 | 3/2012 | |
| DE | 202012100470 U1 * | 3/2012 | A45B 11/00 |

OTHER PUBLICATIONS

Paraplis Umbrella Holder Product listing [online]. Wendy's Walkers Home Health Supplies.Copyright © 2018 www.WendysWalkers.com. [Retrieved on Mar. 23, 2016]. <URL: http://www.wendyswalkers.com/Paraplis-Umbrella-Holder-p/eparaplis081.htm>.

(Continued)

*Primary Examiner* — David R Dunn
*Assistant Examiner* — Danielle Jackson
(74) *Attorney, Agent, or Firm* — Cramer Patent & Design, PLLC; Aaron R. Cramer

(57) ABSTRACT

A device comprising a walker and umbrella utilizes a disk having a plurality of apertures, a handle and a clamp. The clamp is configured to secure about a portion of the walker, or similar structure or be an integral portion thereof. The disk is capable of rotation and features a means for securing an umbrella to the disk.

20 Claims, 5 Drawing Sheets

(56) References Cited

U.S. PATENT DOCUMENTS

2012/0180831 A1* 7/2012 April ..... A45B 11/00
135/16

OTHER PUBLICATIONS

Walker with Swiveling Umbrella Holder. Translation of DE 202012100470 [online]. Google Patents. [retrieved on Mar. 23, 2016.] <URL:https://www.google.com/patents/DE202012100470U1?cl=en&dq=umbrella+attachment+for+walker&hl=en&sa=X&ved=0ahUKEwjFiZD_7tXLAhUH1SYKHTmhCE8Q6AEIHTAA>.
Umbrella Holder for Walker, called "Roschi". Translation of DE 202011107303 [online]. Google Patents. [retrieved on Mar. 23, 2016.] <URL:https://www.google.com/patents/DE202011107303U1?cl=en&dq=umbrella+attachment+for+walker&hl=en&sa=X&ved=0ahUKEwjFiZD_7tXLAhUH1SYKHTmhCE8Q6AEIMAB>.

* cited by examiner

WALKER WITH DEPLOYABLE UMBRELLA

RELATED APPLICATIONS

The present invention was first described in and claims the benefit of U.S. Provisional Application No. 62/326,943, filed Apr. 25, 2016, the entire disclosures of which are incorporated herein by reference.

FIELD OF THE INVENTION

The present invention relates generally to the field of rain and sun protection and more specifically relates to a walker with deployable umbrella.

BACKGROUND OF THE INVENTION

People may need the use of a mobility system, such as a walker, for many reasons. A person may have decreased weight bearing capability where they may not be able to rely on one (1) or both legs for standing, as can happen while recuperating from a leg break or fracture, hip surgery, or from arthritic pain. Another reason for needing a mobility system may be a result of fatigue or decreased endurance whether a result of frailness associated with normal aging, or from respiratory conditions and shortness of breath, deconditioned physical fitness after an extended illness, or from systemic conditions such as diabetes, multiple sclerosis, and Parkinson's disease. Another reason to need the use of a walker may be because a person has poor balance because of neurological conditions such as stroke, multiple sclerosis, cerebral palsy, or diabetic neuropathy. Low blood pressure, dizziness, and slow reflexes may also contribute to poor balance.

Often, a person needing the use of a mobility system is prescribed walks to convalesce and to gain strength and mobility. Other persons who use a mobility system may wish to participate in other outdoor activities, such as gardening with the aid of a walker. Rain and the effects of hot sun may decrease the desire of a person needing the use of a mobility system to perform outdoor activities because it is difficult to hold an umbrella and properly maneuver the walker at the same time. A suitable solution is desired.

Various attempts have been made to solve problems found in rain and sun protection art. Among these are found in: U.S. Pat. Nos. and U.S. Pat. No. 7,726,327 to Battistion; U.S. Pat. No. 5,921,258 to Francois; 2011/0297198 to Sibley; U.S. Pat. No. 8,439,055 to April, et. al.; and European Pat. No. 2,803,288 to Cooper. These prior art references are representative of rain and sun protection.

None of the above inventions and patents, taken either singly or in combination, is seen to describe the invention as claimed. Thus, a need exists for a reliable walker with deployable umbrella, and to avoid the above-mentioned problems.

SUMMARY OF THE INVENTION

The inventor has recognized the aforementioned issues and inherent problems and observed that there is a lack in the prior art for a walker with deployable umbrella.

It is therefore an object of the invention to provide an a walker which comprises a walker body which has a frame member, and at least one (1) pair of wheels attached to the walker frame, a rotational device which comprises a protective case having a first aperture, a rotating hub which is centrally located within the protective case having a second aperture contiguous with the first aperture, a third aperture which is disposed within a protective case peripheral side defining a first cavity and a fourth aperture which is disposed within the protective case peripheral side adjacent the third aperture defining a second cavity.

The walker also has a clasping device configured to be removably attached to the frame member or in a separate embodiment the clasp device may be integral with the frame member. There is also a connection bolt which is secured to the clasping device at a connection bolt first end and resides within the first and second aperture, a fastening means which is secured at a connection bolt second end for positioning the rotational device between the fastening means and the clasping device, a handle rotatingly secured within the first cavity and an umbrella removably secured within the second cavity. The first force upon the handle rotates the rotational device in a first direction about the connection bolt and a second force upon the handle rotates the rotational device in a second direction about the connection bolt.

The rotating hub further comprises an inner hub having a second aperture and an outer hub disposed about the inner hub and secured to the inner hub by a race, a first flange secured to an outer hub peripheral edge and comprising a bottom of the first cavity and a second flange secured to the outer hub peripheral edge adjacent the first flange and comprising a bottom of the second cavity. The handle is removably secured within the first flange. A third force upon the handle results in a locking of the rotational device in a selected position while a fourth force upon the handle results in an unlocking of the rotational device. The fastening means comprises a cap or a wingnut.

The walker may also comprise a lock nut which is disposed on the connection bolt and between the clasping device and the rotational device and a restraining nut which is disposed on the connection bolt and between the lock nut and the rotational device. The protective case may comprise plastic or steel. The rotating hub may comprise steel as well. The umbrella may further comprise a post and a canopy which is deployable from the post. The post may be telescopic.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 3:
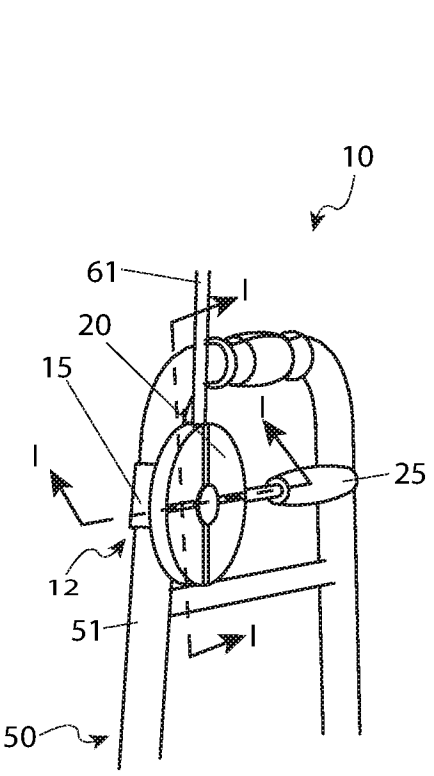
FIG. 3 is a close-up perspective view illustrating the walker with deployable umbrella 10, according to an embodiment of the present invention.

10 walker with deployable umbrella
12 rotational device
15 clasp
20 rotating hub
25 handle
27 rotating hub aperture
29 rotating hub cavity
50 walker
51 walker frame member
59 umbrella
60 canopy
61 post
100 outer protective case
105 first threaded connection
110 outer hub
115 inner hub
120 race system
125 rotational direction "r"
130 flange
135 second threaded connection
140 three hundred sixty degree (360°) travel path
150 main connection bolt
155 restraining nut
160 lock nut
165 decorative cap
170 alternate umbrella
175 alternate canopy
180 alternate telescoping post
185 wing nut
190 alternate main connection bolt The present invention is directed to a walker with deployable umbrella 10. In certain embodiments of the present invention, the rotational device 12 can be either permanently or removably attached to a walker 50.

The walker 50 may minimally be envisioned to have a three-side tubular frame structure comprising a pair of handles, each handle oppositely disposed, at least two (2) wheels secured to the front side base of the walker 50, each wheel oppositely disposed and a pair of protective end caps disposed at bottom end of the walker 50 opposite each wheel. While this configuration is deemed both common and well suited for the device of the instant application, it is not intended to be a limiting feature as other forms of walkers with various numbers of tubular frame members, wheels and protective end caps may also be utilized.

The walker with deployable umbrella 10 comprises a rotational device 12 which comprises a clasp 15 attached to a walker frame member 51 or integral thereto and a rotating and locking hub 20 operably controlling an umbrella 59. The umbrella 59 includes a canopy 60 deployable from a post 61 which may or may not be telescoping, useful for adjusting a height of the canopy 60 as desired by a user. The rotating and locking hub 20 further comprises a handle 25. The rotating and locking hub 20 is useful for unlocking the post 61, and the handle 25 is useful for rotating the post 61 to reposition the canopy 60 to a plurality of positions as desired by the user. The clasp 15 comprises a device to fixedly attach the rotating and locking hub 20 to the walker 50. In a separate embodiment, the clasp 15 may comprise an integral portion of the walker 50.

An additional embodiment of the present invention (not shown) may comprise a canopy 60 with a plurality of telescoping posts 61. The telescoping posts 61 may be fixedly attached to clasps 15 located on the left side and the right side of the walker 50 with the canopy 60 suspended between, useful for providing shade and rain protection while a user is directly underneath the canopy 60.

Figure 2:
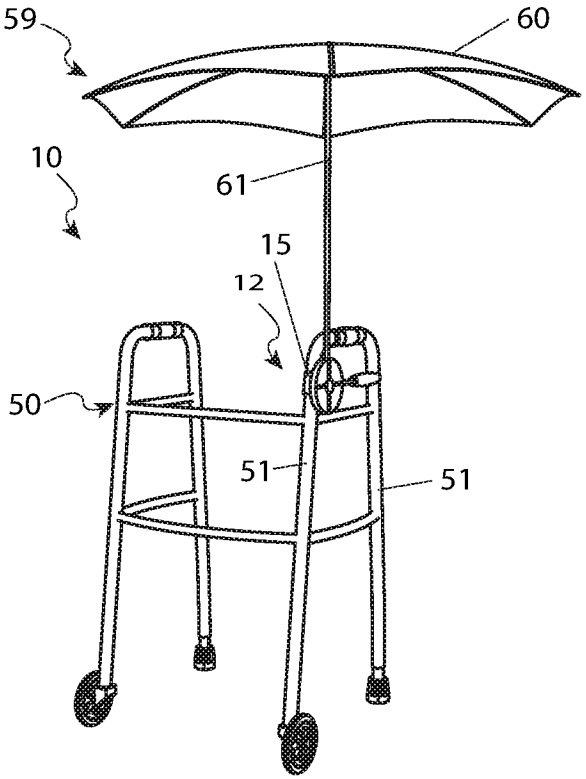
FIG. 2 is a front perspective view illustrating the walker with deployable umbrella 10, during an "in-use" condition, according to an embodiment of the present invention.
Figure 1:
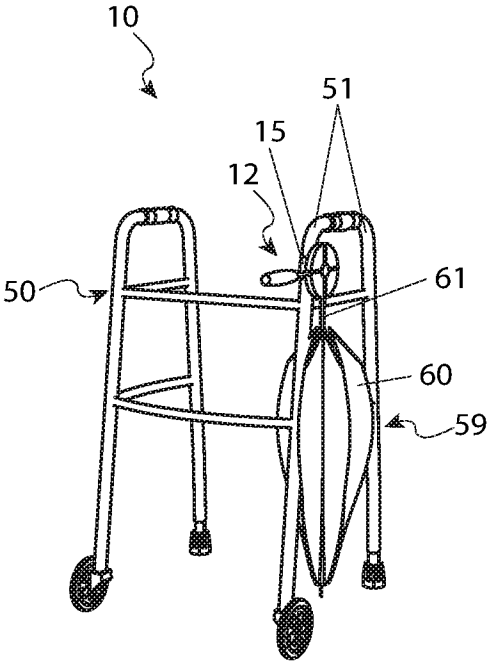
FIG. 1 is a front perspective view of a walker with deployable umbrella 10 for a walker 50, during a "ready-to-use" condition, according to an embodiment of the present invention.

Referring now to the drawings, there is shown in FIG. 1 the walker with deployable umbrella 10 during a "ready-to-use" condition and FIG. 2, showing a perspective view of the walker with deployable umbrella 10 during an "in-use" condition. The canopy 60 is elevated by exercising the handle 25 to rotate the rotating and locking hub 20 to rotate the umbrella 59 such that the post 61 and canopy 60 is oriented in a vertical position to allow a user to benefit from the canopy 60. The rotating and locking hub 20 allows the canopy 60 to be placed in the plurality of positions as desired by the user needing protection from rain of the effects of the sun. The post 61 allows the user to reposition the height of the canopy 60, useful for accommodating persons of varying heights. The walker with deployable umbrella 10 may be useful for a person needing the aid of the walker 50 to walk during a rain storm or on a sunny day while employing rain and sun protection by raising the canopy 60 to a desired height, and rotating the post 61 to a desired position. The person needing the aid of the walker 50 may then be able to use both hands on the walker 50 to properly guide the walker 50.

Referring now to FIG. 3, a close-up view illustrating the rotating and locking hub 20 of the rotational device 12 of the walker with deployable umbrella 10, according to an embodiment of the present invention. The post 61 is affixed to the side of rotating and locking hub 20. The rotating and locking hub 20 further comprises the handle 25, which is affixed to the side of the rotating and locking hub 20, preferably ninety degrees (90°) away from the post 61. The rotating and locking hub 20 may be useful for unlocking and rotating the post 61 with the handle 25, useful for repositioning the canopy 60 to the plurality of positions as desired by the user.

In a first embodiment, the clasp 15 comprises a device to fixedly attach the rotating and locking hub 20 to a walker frame member 51. The clasp 15 is preferably a spring-loaded pair of jaws or other similar type of clamp that biases the jaws together such that the walker frame member 51 is entrapped therebetween. The clasp 15 is preferably affixed to a rear surface of the rotating and locking hub 20.

Figure 4:
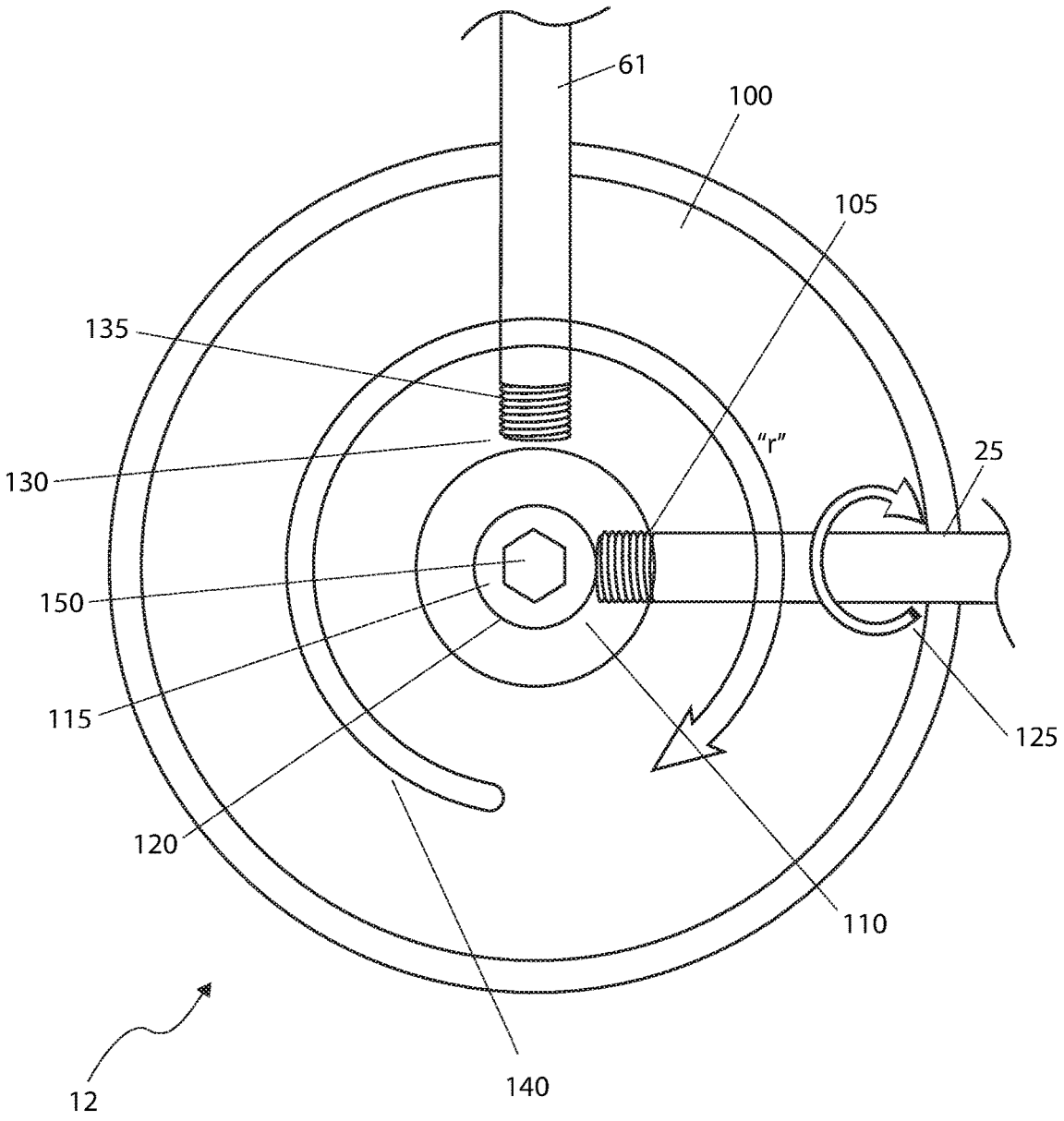
FIG. 4 is a sectional view as seen along a line I-I, as shown in FIG. 3, of a rotational device 12, according to an embodiment of the present invention.
Figure 5:
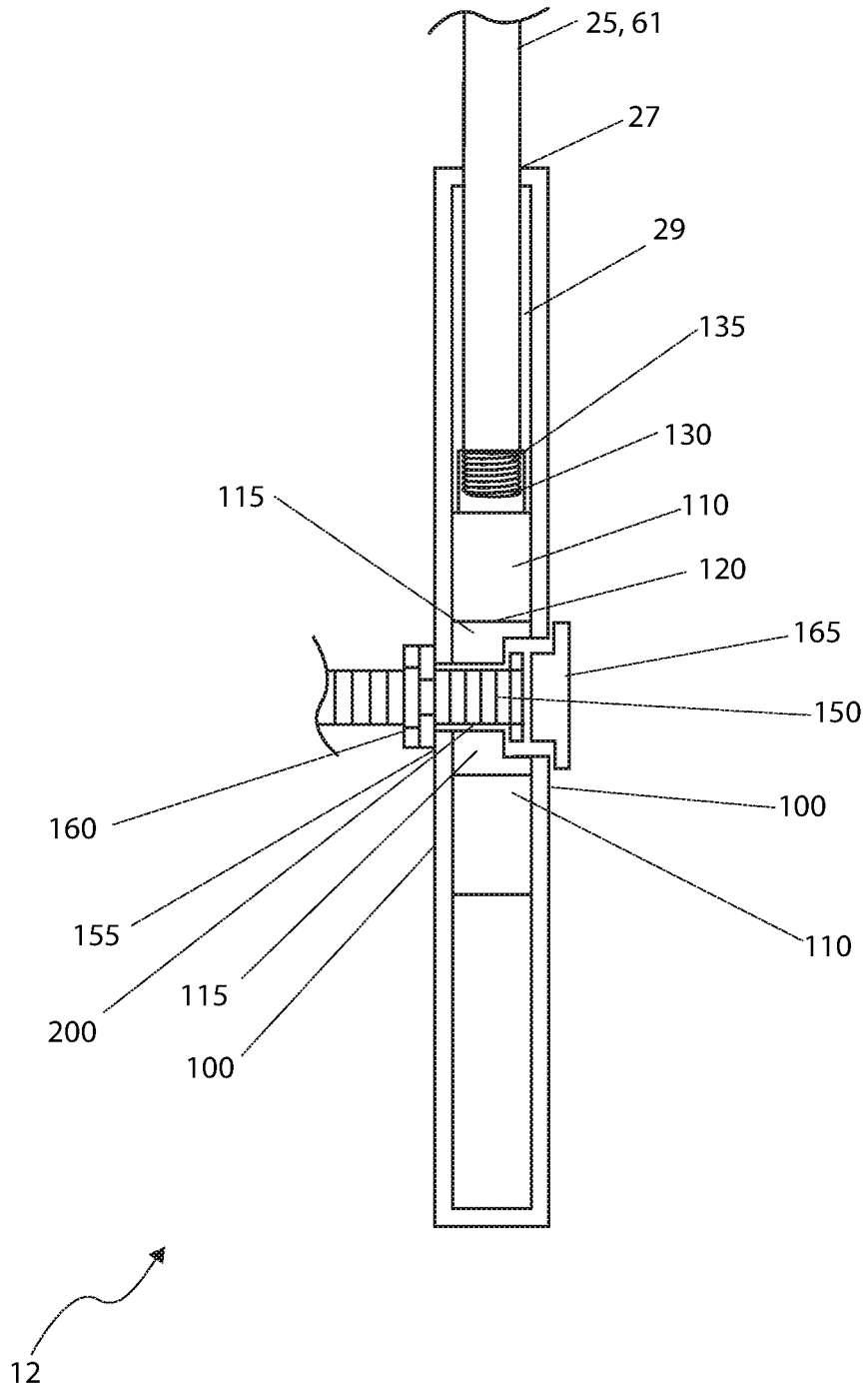
FIG. 5 is a sectional view as seen along a line II-II, as shown in FIG. 3, of the rotational device 12, according to an embodiment of the present invention.

Referring now to FIGS. 4 and 5, a sectional view as seen along a line I-I, as shown in FIG. 3, of the rotational device 12, according to an embodiment of the present invention is depicted. The handle 25 enters through an outer protective case 100 having a first rotating hub aperture 27, envisioned to be made of durable plastic or sheet steel. The first rotating hub aperture 27 provides access to a first rotating hub cavity 29. The base of the rotating hub cavity 29 terminates via a first threaded connection 105 in an outer hub 110 which is physically connected to an inner hub 115 via a race system 120. The handle 25 when tightened in a rotational direction "r" 125 results in the handle 25 impinging upon the inner hub 115 thus preventing rotational movement of the outer hub 110. The post 61 from the umbrella 59 (as shown in FIG. 1) is connected into a flange 130 via a second threaded connection 135. The flange 130 is permanently affixed to the outer hub 110 via welding or other similar process. It is envisioned that the outer hub 110, the inner hub 115 and the flange 130 would be made of metal such as steel. As such, the outer hub 110 can travel in a three hundred sixty degree (360°) travel path 140 in relation to the inner hub 115 and be afforded the ability to lock together at any incremental point along the three hundred sixty degree (360°) travel path 140 by tightening the handle 25. It should be noted that during said travel, the post 61 remains at an approximate angle of ninety degrees (90°) to the handle 25. A main connection bolt 150 is then provided at the center of the outer protective case 100 forming a rotational axis strength member which will be described in greater detail herein below.

Figure 7:
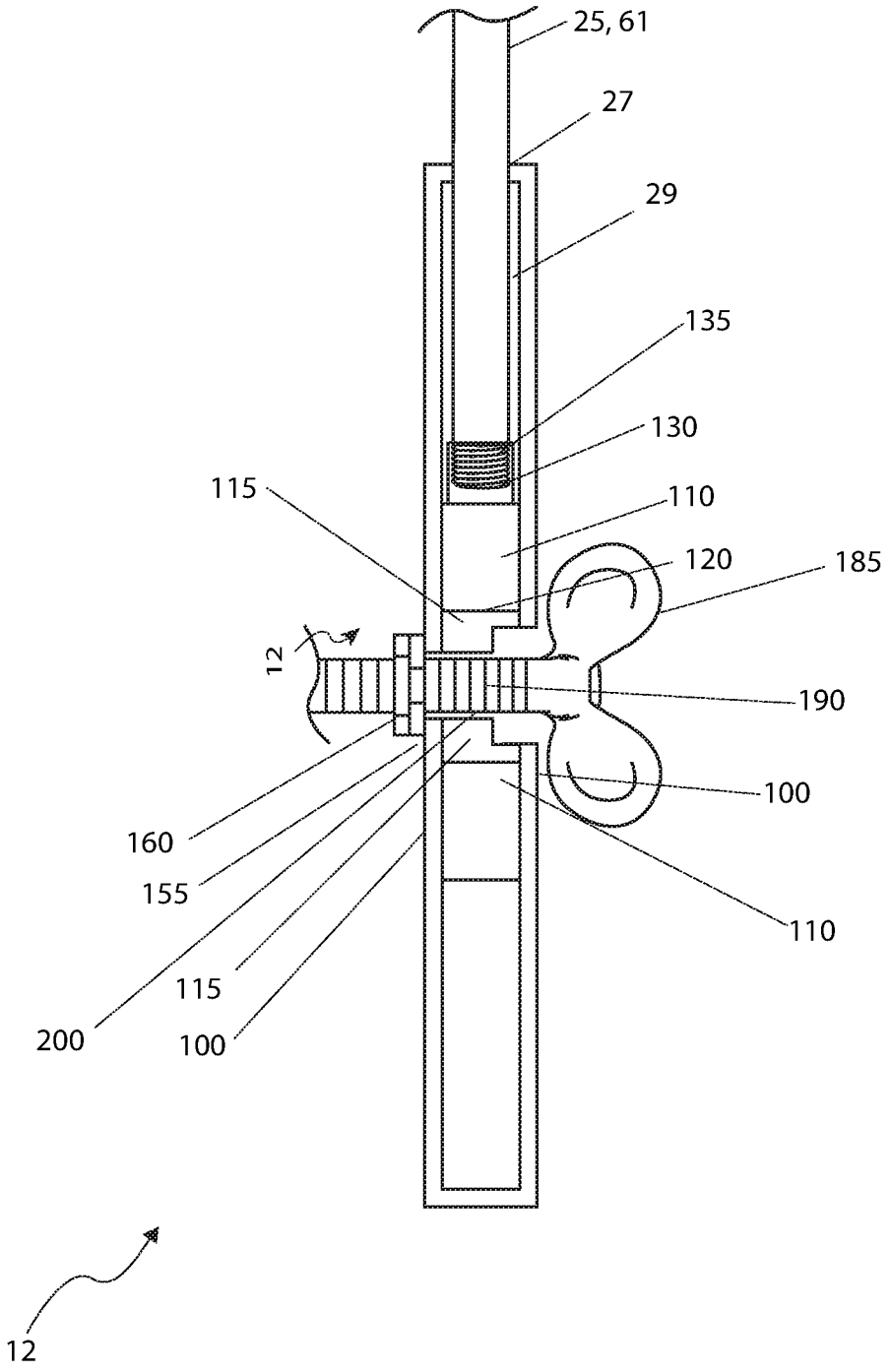

Referring further to FIG. 5, a sectional view as seen along a line II-II, as shown in FIG. 3, of the rotational device 12, according to an embodiment of the present invention is disclosed. The post 61 is shown connected to the flange 130 by the second threaded connection 135 as aforementioned described i.e., the post 61 passes through a second rotating hub aperture 27 and resides within a second rotating hub cavity 29. It should be noted that the handle 25 (as shown in FIG. 4) is not visible due to illustrative limitations. The outer hub 110 is connected to the inner hub 115 via a race system 120. The inner hub 115 is connected to the outer hub 110 as well as an outer protective case 100 via a main connection bolt 150 which is threaded for its entire length. A restraining nut 155 working in conjunction with a lock nut 160 allows for the proper amount of tension to be applied to hold the outer hub 110, the inner hub 115, and the outer protective case 100 together, yet allow for rotational movement when the handle 25 (as shown in FIG. 4) is loosened during raising and lowering operations of the umbrella 59 (as shown in FIG. 1). The distal end of the main connection bolt 150 continues on to the clasp 15 (as shown in FIG. 1) thus forming a horizontal strength member of rotational device 12. A decorative cap 165 is then applied over the main connection bolt 150 where it is held in place via friction fit to the outer protective case 100. In a separate embodiment illustrated in FIG. 7, the decorative cap 165 of the rotational device 12 is replaced by a wingnut 185 while the main connection bolt 150 is replaced with an alternate main connection bolt 190 which is configured to threadingly engage with the wingnut 185. In this configuration, the wingnut 185 provides an additional means of securing the rotating hub 20 into position.

Figure 6:
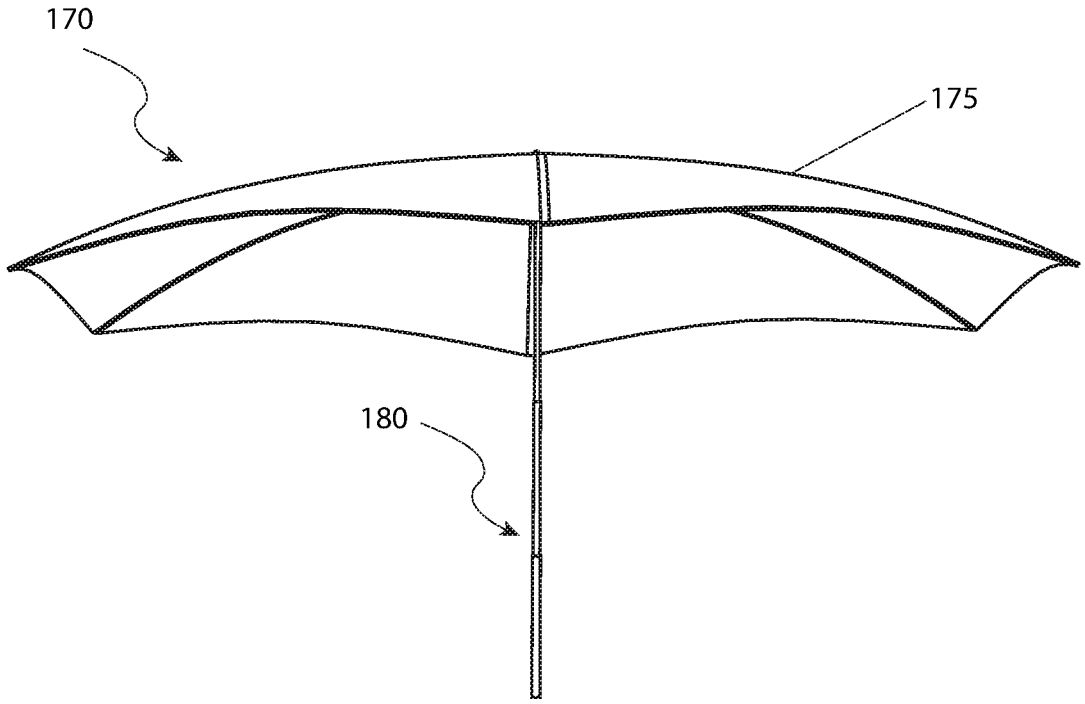
FIG. 6 is a close-up view illustrating the umbrella 170 and post 180, according to a separate embodiment of the present invention; and, FIG. 7 is a sectional view as seen along a line II-II, as shown in FIG. 3, of the rotational device 12, according to a separate embodiment of the present invention.

Referring now to FIG. 6, a close-up view illustrating the umbrella 170 and post 180, according to a separate embodiment of the present invention is disclosed. With respect to this embodiment, the post 180 is telescoping thereby consisting of overlapping sections capable of sliding together or sliding apart.

The exact specifications, materials used, and method of use of the walker with deployable umbrella 10 may vary upon manufacturing.

The foregoing descriptions of specific embodiments of the present invention have been presented for purposes of illustration and description. They are not intended to be exhaustive or to limit the invention to the precise forms disclosed, and obviously, many modifications and variations are possible considering the above teaching. The embodiments were chosen and described to best explain the principles of the invention and its practical application, to thereby enable others skilled in the art to best utilize the invention and various embodiments with various modifications as are suited to the use contemplated.

What is claimed is:

1. A walker, comprising:

a walker body, having a frame member, and at least one pair of wheels attached to said frame member;

a rotational device, comprising:

a protective case having a first aperture;

a rotating hub centrally located within said protective case having a second aperture contiguous with said first aperture;

a third aperture disposed within a protective case peripheral side defining a first cavity; and, a fourth aperture disposed within said protective case peripheral side adjacent said third aperture defining a second cavity;

a clasping device configured to be removably attached to said frame member;

a connection bolt secured to said clasping device at a connection bolt first end and residing within said first aperture and said second aperture;

a fastening means secured at a connection bolt second end for positioning said rotational device between said fastening means and said clasping device;

a handle rotatingly secured within said first cavity; and, an umbrella removably secured within said second cavity;

wherein a first force upon said handle rotates said rotational device in a first direction about said connection bolt; and, wherein a second force upon said handle rotates said rotational device in a second direction about said connection bolt, opposite said first direction.

2. The walker of claim 1, wherein said rotating hub further comprises:

an inner hub comprising said second aperture;

an outer hub disposed about said inner hub and secured to said inner hub by a race;

a first flange secured to an outer hub peripheral edge and comprising a bottom of said first cavity; and, a second flange secured to said outer hub peripheral edge adjacent said first flange and comprising a bottom of said second cavity;

wherein said handle is removably secured within said first flange;

wherein a third force upon said handle results in a locking of said rotational device in a selected position; and, wherein a fourth force upon said handle results in an unlocking of said rotational device.

3. The walker of claim 1, wherein said fastening means comprises a cap.

4. The walker of claim 1, wherein said fastening means comprises a wingnut.

5. The walker of claim 1, further comprising:

a lock nut disposed on said connection bolt and between said clasping device and said rotational device; and, a restraining nut disposed on said connection bolt and between said lock nut and said rotational device.

6. The walker of claim 1, wherein said protective case comprises plastic.

7. The walker of claim 1, wherein said protective case comprises steel.

8. The walker of claim 1, wherein said rotating hub comprises steel.

9. The walker of claim 1, wherein said umbrella comprises:

a post; and, a canopy deployable from said post.

10. The walker of claim 9, wherein said post is telescopic.

11. A walker, comprising:

a walker body, having a frame member, and at least one pair of wheels attached to said frame member;

a rotational device, comprising:

a protective case having a first aperture;

a rotating hub centrally located within said protective case having a second aperture contiguous with said first aperture;

a third aperture disposed within a protective case peripheral side defining a first cavity; and, a fourth aperture disposed within said protective case peripheral side adjacent said third aperture defining a second cavity;

a clasping device integral to said frame member;

a connection bolt secured to said clasping device at a connection bolt first end and residing within said first aperture and said second aperture;

a fastening means secured at a connection bolt second end for positioning said rotational device between said fastening means and said clasping device;

a handle rotatingly secured within said first cavity; and, an umbrella removably secured within said second cavity;

wherein a first force upon said handle rotates said rotational device in a first direction about said connection bolt; and, wherein a second force upon said handle rotates said rotational device in a second direction about said connection bolt opposite said first direction.

12. The walker of claim 11, wherein said rotating hub further comprises:

an inner hub comprising said second aperture;

an outer hub disposed about said inner hub and secured to said inner hub by a race;

a first flange secured to an outer hub peripheral edge and comprising a bottom of said first cavity; and, a second flange secured to said outer hub peripheral edge adjacent said first flange and comprising a bottom of said second cavity;

wherein said handle is removably secured within said first flange;

wherein a third force upon said handle results in a locking of said rotational device in a selected position; and, wherein a fourth force upon said handle results in an unlocking of said rotational device.

13. The walker of claim 11, wherein said fastening means comprises a cap.

14. The walker of claim 11, wherein said fastening means comprises a wingnut.

15. The walker of claim 11, further comprising:

a lock nut disposed on said connection bolt and between said clasping device and said rotational device; and, a restraining nut disposed on said connection bolt and between said lock nut and said rotational device.

16. The walker of claim 11, wherein said protective case comprises plastic.

17. The walker of claim 11, wherein said protective case comprises steel.

18. The walker of claim 11, wherein said rotating hub comprises steel.

19. The walker of claim 11, wherein said umbrella comprises:

a post; and, a canopy deployable from said post.

20. The walker of claim 19, wherein said post is telescopic.

* * * * *